US005545944A

United States Patent [19]

Cannon

[11] Patent Number: 5,545,944

[45] Date of Patent: Aug. 13, 1996

[54] BASE FOR SINGLE PIN ELONGATED LAMP

[75] Inventor: Donald M. Cannon, Dover, Pa.

[73] Assignee: Osram Sylvania, Inc., Danvers, Mass.

[21] Appl. No.: 385,416

[22] Filed: Feb. 8, 1995

[51] Int. Cl.[6] ..... H01J 5/48

[52] U.S. Cl. ..... 313/318.01; 313/318.02; 313/318.03; 439/602

[58] Field of Search ..... 313/318.01, 318.02, 313/318.03, 318.08, 318.12, 51; 439/220, 602, 612, 613

[56] References Cited

U.S. PATENT DOCUMENTS

| | | | |
|---|---|---|---|
| 3,014,196 | 12/1961 | Shappel | 313/318.02 |
| 4,994,710 | 2/1991 | Roelevink et al. | 313/318.02 |
| 5,013,962 | 5/1991 | Desclos | 313/318.02 |
| 5,032,759 | 7/1991 | Thiry et al. | 313/318.03 |

FOREIGN PATENT DOCUMENTS

| | | | |
|---|---|---|---|
| 0067818 | 6/1940 | Czechoslovakia | 313/318.01 |
| 2075251 | 11/1991 | United Kingdom | 313/318.01 |

*Primary Examiner*—Sandra L. O'Shea
*Assistant Examiner*—Ashok Patel
*Attorney, Agent, or Firm*—William H. McNeill

[57] ABSTRACT

A fluorescent lamp includes: an elongated, hermetically sealed transluscent glass envelope containing an electrode at each end thereof, each of said electrodes including an electron emitting portion and two lead-in wires. The lead-in wires extend outside of the envelope and are connected together to form one lead-in wire. A base is provided at each end of the envelope with each of the bases comprising a cup-shaped, electrically conductive outer shell having a bottom and an upstanding peripheral wall; an opening in the bottom and an electrically insulating member fixed in the opening. An electrically conductive, depending pin is affixed to the electrically insulating member; and an electrically insulating, upstanding wall is formed on the inner or lamp side of the insulating member, opposite the pin and within the confines of the peripheral wall. The lead-in wire is electrically connected to the depending pin and the bases are affixed to the envelope.

3 Claims, 2 Drawing Sheets

BASE FOR SINGLE PIN ELONGATED LAMP

TECHNICAL FIELD

This invention relates generally to lamps and more particularly to elongated lamps. Still more particularly, it relates to bases for single pin fluorescent lamps.

BACKGROUND ART

Single pin fluorescent lamps are known and have been constructed with a variety of diameters; e.g., T6, T8, T12 (T1=⅛"). In the smaller sizes, notably T8 and below, it has been necessary to fabricate the bases of plastic or other electrically insulating material to avoid having the emitter electrode wires come in contact with the base and cause a short circuit. This problem did not exist in the T12 sizes, which were made with an electrically conductive base having an insulating center portion fixed therein. The larger diameter of the T12 lamp provided insurance against the electrode wires coming into contact with the electrically conductive base. The use of electrically conductive bases is highly advantageous because of strength and ease of making. Also, such bases are less expensive.

DISCLOSURE OF THE INVENTION

It is, therefore, an object of the present invention to obviate the disadvantages of the prior art.

It is another object of the invention to enhance fluorescent lamps.

Still another object of the invention is the provision of metal shelled bases for small diameter lamps.

These objects are accomplished, in one aspect of the invention, by a base for a lamp comprising: a cup-shaped, electrically conductive outer shell having a bottom and an upstanding peripheral wall; an opening in said bottom; an electrically insulating member fixed in said opening; an electrically conductive, depending pin affixed to said electrically insulating member; and an electrically insulating, upstanding wall formed on said insulating member, opposite said pin and within the confines of said peripheral wall.

The structure described above is economical to manufacture and the internal wall prevents the electrode wires from contacting the metal shell thus avoiding short circuits.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
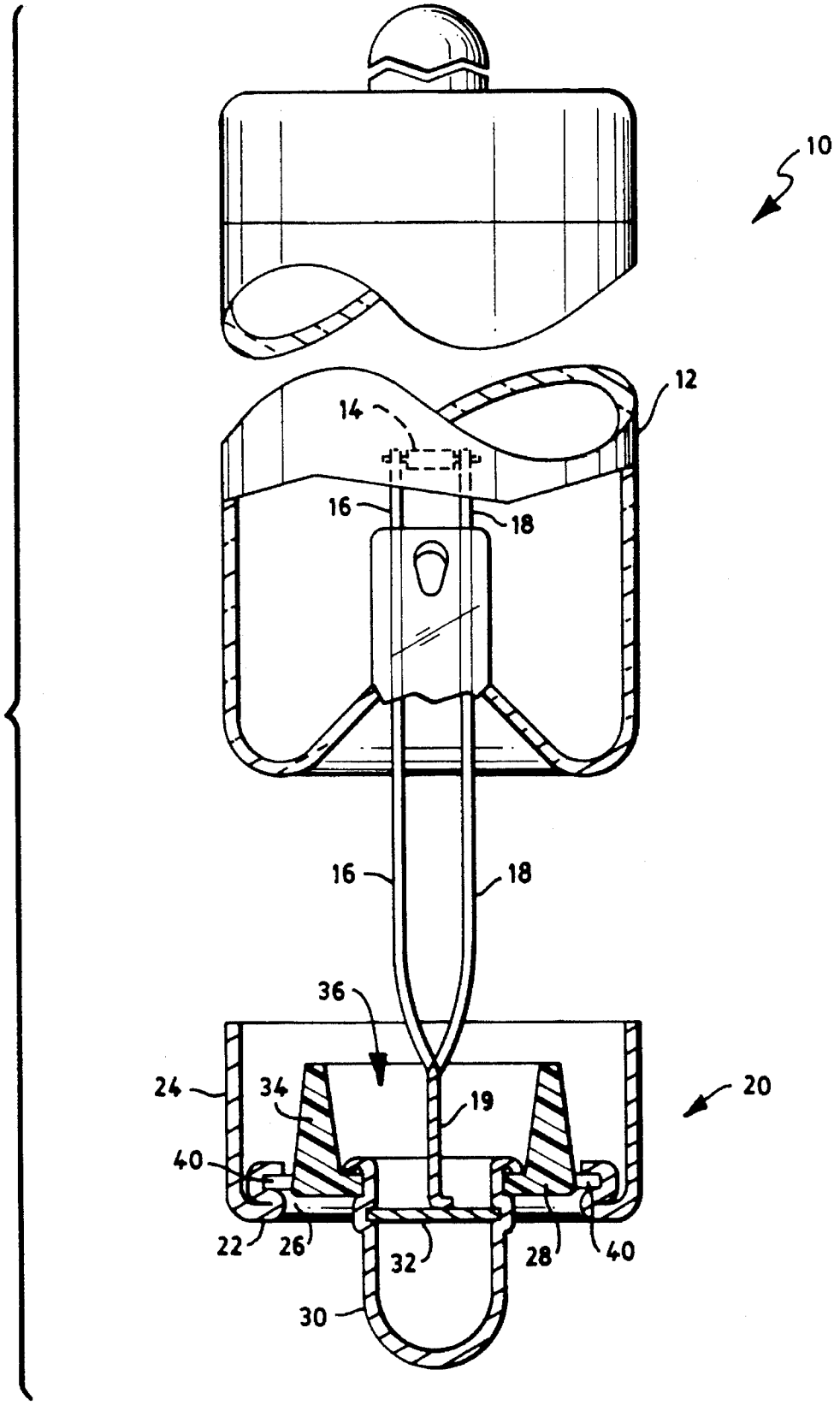
FIG. 1 is an elevational view of a lamp and a base in accordance with an aspect of the invention, partially in section.

Referring now to the drawings with greater particularity, there is shown in FIG. 1 a fluorescent lamp 10 having an elongated, hermetically sealed, tubular envelope 12 with a filamentary electrode 14 (only one of which is shown) supported by lead-in wires 16 and 18, at each end thereof. The lead-in wires at the end of the envelope are helically twisted together, as at 19, to form, in effect, a single composite wire.

The base 20 comprises an annular metal shell, preferably of aluminum, having a bottom 22 and an upstanding peripheral wall 24. The bottom 22 has an opening 26 therein into which is fitted an electrically insulating member 28 from which depends a metal pin 30 having a metal disc 32 crimped therein. The base as thus far described is shown in U.S. Pat. No. 3,014,196 and the teachings thereof are hereby incorporated by reference.

Bases such as that shown in the above-referenced patent are perfectly adequate for larger diameter bulbs, e.g., T12; however, as the bulb diameter decreases, the danger of shorting of the lead-in wires against the metal shell increase. This occurs because the extra length of the wires necessary to allow the weld to be made to the disc 32 (see FIG. 1 ) has to be accommodated within the base. Because this has been a problem in the smaller diameter bulbs, the industry turned to making bases for these smaller diameter lamps from electrically insulating material, even though such a solution added cost and a greater risk of breakage.

Figure 2:
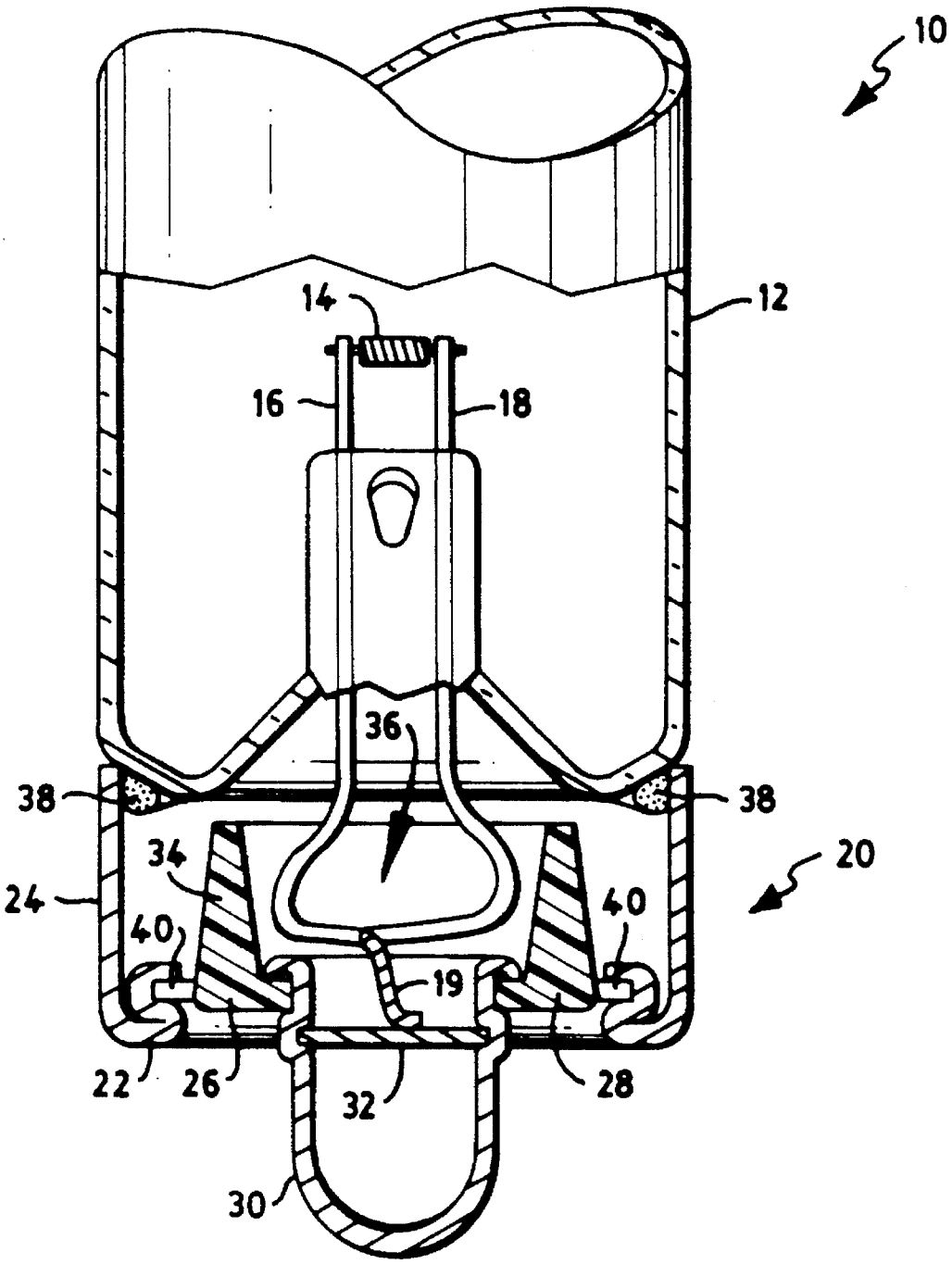
FIG. 2 is a partial, sectional view of a lamp with an assembled base.

The shorting problem is addressed herein by an upstanding, electrically insulating wall 34 formed on the inside, or lamp side, of the member 28 which wall forms a cavity 36 to receive the extra wire length, as is shown in FIG. 2. This internal wall prevents the lead-in wires 16 and 18 from contacting the metal wall of the base.

The base 10 can be conventionally mounted to the end of the lamp by means of cement 38 and, preferably is provided with a number of peripheral apertures 40 to allow venting when the base is applied to the lamp.

There is thus provided a metal shelled base for small diameter fluorescent having all the benefits of strengths and economical cost without the dangers of short circuiting to the outer shell.

While there have been shown and described what are at present considered the preferred embodiments of the invention, it will be apparent to those skilled in the art that various changes and modifications can be made herein without departing from the scope of the invention as defined by the appended claims.

What is claimed is:

1. A lamp comprising: an elongated, hermetically sealed transluscent, glass envelope having a diameter of T8 or less and containing an electrode at each end thereof, each of said electrodes comprising an electron emitting portion and two lead-in wires, said lead-in wires extending outside of said envelope, said lead-in wires being connected together to form one lead-in wire; and a base at each end of said envelope, each of said bases comprising a cup-shaped, electrically conductive outer shell having a bottom and an upstanding peripheral wall; an opening in said bottom; an electrically insulating member fixed in said opening; an electrically conductive, depending pin affixed to said electrically insulating member substantially at the center thereof; and an electrically insulating, upstanding wall formed on said insulating member, opposite said pin and within the confines of said peripheral wall, said lead-in wire extending within said electrically insulating, upstanding wall and being electrically connected to said depending pin and said bases being affixed to said envelope.

2. The lamp of claim 1 wherein said lead-in wire is elongated and is constrained from contact with said electrically conductive outer shell by said electrically insulating upstanding wall formed on said insulating member.

3. The lamp of claim 1 wherein said upstanding peripheral wall has a given height and said electrically insulating upstanding wall has a height less than but substantially equal to said given height.

* * * * *